United States Patent [19]

Fujita

[11] Patent Number: 4,479,842

[45] Date of Patent: Oct. 30, 1984

[54] MANUALLY-OPERATED LABELER

[75] Inventor: Mituo Fujita, Sakatoshi, Japan

[73] Assignee: Kabushiki Kaisha Shinsei Industries, Tokyo, Japan

[21] Appl. No.: 444,814

[22] Filed: Nov. 23, 1982

[51] Int. Cl.[3] ..... B65C 11/02

[52] U.S. Cl. ..... 156/384; 101/288; 156/541; 156/577; 156/579; 156/584; 156/DIG. 49

[58] Field of Search ..... 156/384, 541, 577, 579, 156/584, DIG. 48, DIG.49; 101/288, 291, 292

[56] References Cited

U.S. PATENT DOCUMENTS 3,468,739 9/1969 Schrotz ..... 156/384
3,837,966 9/1974 Finke ..... 156/384
4,301,729 11/1981 Fujita ..... 101/291
4,414,054 11/1983 Becker et al. ..... 156/384

*Primary Examiner*—Michael G. Wityshyn
*Attorney, Agent, or Firm*—Wenderoth, Lind & Ponack

[57] ABSTRACT

A manually-operated labeler in which a carrier strip onto which a number of labels are stuck in succession is turned back at a carrier strip turnback part mounted in a casing and fed intermittently to separate and forward a label from the carrier strip and the separated and forwarded label is depressed onto an article by a depressing member provided ahead the carrier strip turnback part by virtue of a motion to stick the label onto the article and to pull the labeler, wherein the carrier strip turnback part and depressing member are detachably mounted on the casing.

4 Claims, 5 Drawing Figures

MANUALLY-OPERATED LABELER

BACKGROUND OF THE INVENTION

The present invention relates to a manually-operated labeler which separates and forwards the label by turning back the carrier strip on which labels are stuck in succession at a carrier strip turnback part and intermittently feeds the carrier strip and performs printing on the label before it is detached at the carrier strip turnback part.

In known labelers of this type, as described in the specification of the U.S. Pat. No. 4,301,729, the label receiving part is often made of a synthetic resin to improve printing. Most labelers of this type are made up by integrally molding the label receiving part and the casing by a molding process and accordingly the casing is also made of a synthetic resin.

However, such a labeler is disadvantageous in that the label receiving part is prone to be broken or damaged since the label receiving part which is often depressed by the printing device is not very strong and consequently it cannot help abandoning the label due to the breakage or damage described above.

An object of the present invention is to make a label receiving member as a single independent part which can be remountably fitted in the casing of the labeler, thus permitting the use of the labeler as is after replacement of the label receiving member if it is damaged or malfunctions.

Another object of the present invention is to eliminate the need to adjust the relative positions of the carrier strip turnback part and the depressing member, at the time of replacement of the label receiving member by combining the label receiving member with the depressing member as a unit.

SUMMARY OF THE INVENTION

The present invention provides a manually-operated labeler comprising a casing from which a handle is extended and formed and to which a lever is pivotally connected so as to oppose the handle, a feed mechanism which is located in said casing, such as, for example, a feed drum provided with a one-way clutch, a driving means for driving said feed mechanism, provided in the actuating part of said lever in said casing such as, for example, a rear gear which engages with said one-way clutch, a printing device fitted to the actuating part of said lever, and a label receiving member which is detachably mounted at the opposite side to said handle in the front part of said casing, said label receiving member comprising a label receiving segment located so as to oppose an array of type of said printing device, a support frame provided integrally with said label receiving segment to support at least one end of the label receiving segment, a depressing member such as, for example, a depression roller which is provided on said support frame to be in parallel with said label receiving segment, a label forwarding space formed between said label receiving segment and said depressing member, and a carrier strip turnback part provided on the edge of said label receiving segment at the label forwarding space side thereof, wherein the carrier strip onto which a number of labels are stuck is turned back at said carrier strip turnback part and is intermittently fed by driving said feed mechanism with said lever to separate said label from the carrier strip and forward it from the label forwarding space to a position under the depressing member, and said printing device performs printing on the label held on the label receiving segment with the operation of said lever while said feed mechanism is not feeding said feed tape.

BRIEF DESCRIPTION OF THE DRAWINGS

The present invention is illustrated in detail by the acompanying drawings in which.

DETAILED DESCRIPTION OF THE INVENTION

Figure 1:
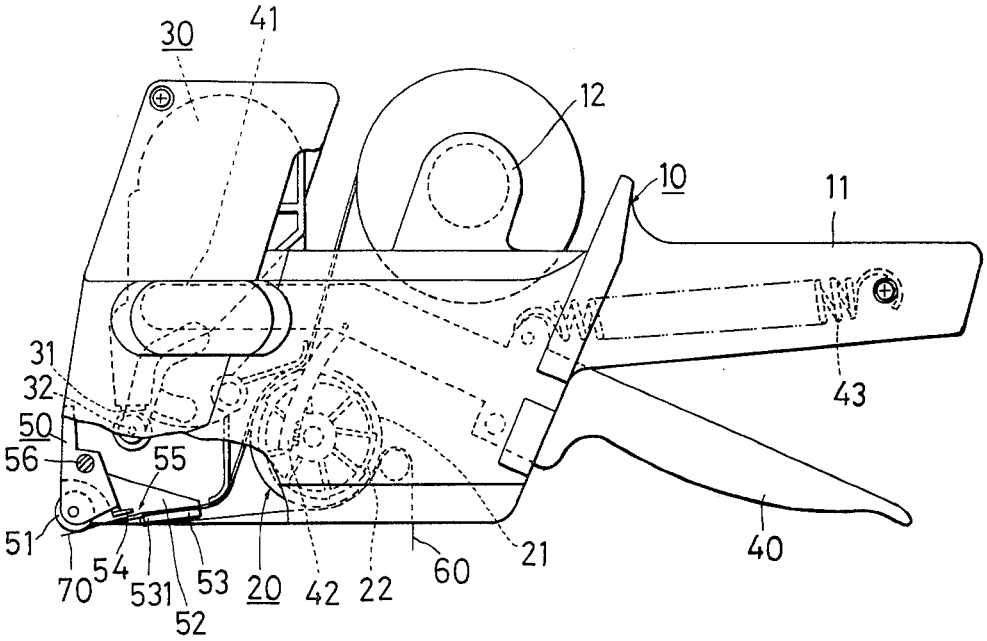
FIG. 1 is a cutaway side view of the principal part of the labeler in accordance with the present invention.
Figure 2:
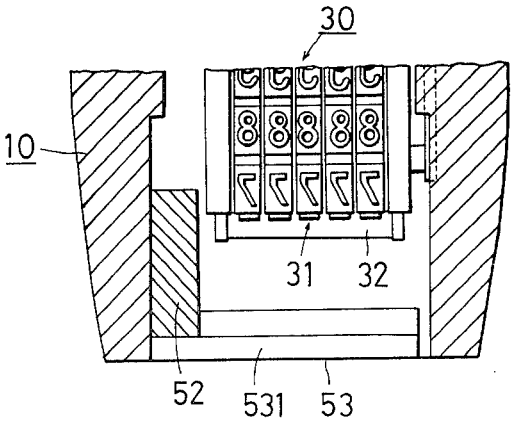
FIG. 2 is a magnified front view of the principal part of said labeler while being lowered.

The following describes the labeler of the present invention by the accompanying drawings. In FIG. 1, there is shown a casing 10 which has a handle 11 formed toward its rear side and incorporates a feed mechanism 20 and a printing device 30 and is fitted with a lever 40 which is pivotally mounted to the casing so as to oppose said handle 11.

Feed mechanism 20 is provided with a feed drum 21 and a one-way clutch 22 arranged on said feed drum 21, and said one-way clutch 22 is driven by pivotal movement of said lever 40. For this reason, the moving part of said lever 40 included in the casing is an actuating part 41 which is provided with driving means such as, for example, rack gear 42 which engages with and drives the one-way clutch 22. In the embodiment, the driving means is set so that the feed drum 21 does not rotate when the lever 40 is pivoted toward the handle 11 and the feed drum rotates to a specified angle when the lever 40 is operated in a direction to part from the handle 11.

Lever 40 is provided with resetting means such as, for example, resetting spring 43 by which the lever 40 is always biased away from the handle 11.

The printing device 30 is mounted on actuating part 41. Actuating part 41 is constructed so that the printing device 30 is lowered when the lever 40 is pivoted toward the handle 11 and the printing device 30 is raised and reset when the lever 40 is reset.

Printing device 30 has a similar construction to that employed in conventional labelers. The printing device is constructed so that the printing face 31 for printing has print type arranged on the underside of the printing device and the combination of elements of the printing face 31 can be varied as required.

This printing face 31 of the array of print type is rubbed by the ink roller 32 to apply thereto the printing ink when the printing device 30 is lowered.

Figure 3:
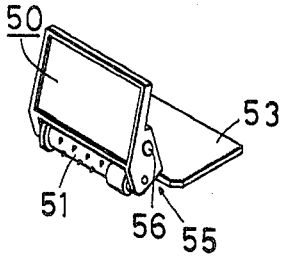
FIG. 3 is a perspective view of the label receiving member to be employed in the labeler of the present invention.
Figure 4:
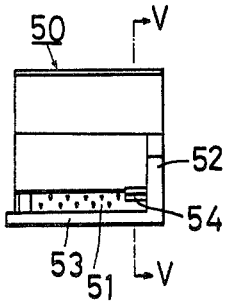
FIG. 4 is a rear view of the above.
Figure 5:
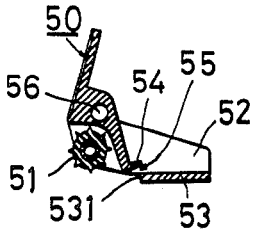
FIG. 5 is a cross-sectional view along the line V—V in FIG. 4.

The front part of said casing 10 at the side opposite that of said handle 11 is provided with a label receiving member 50 detachably mounted thereto. Member 50 is provided with a support frame 52 which supports a depressing member such as, for example, depression roller 51, a label receiving segment 53 and a label holding member 54 as shown in FIGS. 3 to 5. Label receiving segment 53 is made of a resilient member which extends in parallel with said depression roller 51, and of which one end is connected to the support frame 52 and the other end is made as a free end, and the label receiving segment 53 opposes said depression roller 51 through the label forwarding space 55. The front edge of label receiving segment 53 which faces this label forwarding space 55 forms a turnback part 531.

Label holding member 54 extends above said label forwarding space 55 from said support frame 52 to the label receiving segment 53 and the label 70 separated from the carrier strip 60 is held at its upper surface.

Labels 70 are stuck in succession on the upper surface of long carrier strip 60 with the adhesive layer, and this carrier strip 60 is coiled in the form of roll and retained in the carrier strip holder 12 of said casing 10.

This carrier strip 60 is made the same as those used in conventional labelers. As shown in FIG. 1, the carrier strip is pulled out from said carrier strip holder 12, turned back at the turnback part 531 of said label receiving segment 53 and fed as far as specified by rotation of the feed drum 21 while being engaged with said feed drum 21.

Label 70 is separated from the carrier strip 60 due to the stiffness thereof when the carrier strip 60 is fed across turnback part 531, and is caused to protrude toward the lower part of the depression roller 51 from said label forwarding space 55 as shown in FIG. 1.

Label receiving member 50 is provided with fitting means for fitting it to said casing 10 and, in the embodiment, a threaded member and threaded hole 56 is provided as this fitting means. In the embodiment, since this threaded hole 56 is located above and slightly rearward of said depression roller 51, said label receiving member can be attached to the wall of casing 10 with an interval from the front end of the casing 10 and therefore the diameter of the thread can be easily increased and simultaneously the supporting strength of the casing for the label receiving member 50 can also be increased.

Though the label receiving segment 53 is coupled to the support frame 52 at only one of ends in this embodiment, this label receiving segment 53 can be coupled to the support frame so that both ends of the label receiving segment are coupled to the support frame 52.

The labeler of the present invention is provided with the label receiving member 50, which is made up by combining integrally the depressing member and the label receiving segment to be detachably remountable on the front part of the casing and therefore the following effects can be expected.

Differing from the construction wherein the depression roller is pivotably mounted at the front end of the casing as in the conventional labelers, the depression members such as the depression roller 51, etc. are provided on the label receiving member 50 and therefore the diameter of the shaft of the depression roller 51 can be reduced; thus the tilting and pivoting performance of the labeler around the depression roller 51 as the center when sticking a label onto an article can be improved, and moreover, the part of the depression roller 51 which protrudes from the front end of the casing 10 can be increased because the position of the depressing member, especially the depression roller 51, is not limited by the position of the pivotal connection on the casing 10.

Since the depressing member and the label receiving segment 53 are employed as a set, these parts can be replaced without positional adjustment of these parts and accordingly the user can directly replace or repair at the working site the depressing member and the label receiving segment, which are the elements most often in need of repair or replacement, at the same time, and the service life of the labeler can thereby be substantially prolonged.

What is claimed is:

1. A manually-operable labeler which removes and prints upon labels successively stuck to a carrier strip, comprising:

a. a casing having a handle extending rearwardly thereof;

b. a lever pivotally mounted to said casing opposed to said handle so as to be reciprocally pivotable toward and away from said handle;

c. a carrier strip feeding mechanism housed in said casing, engagable with the carrier strip and responsive to pivoting of said lever to feed a fixed length of carrier strip, said carrier strip remaining stationary during a portion of the reciprocating pivotal movement of said lever;

d. a printing device mounted in said casing and responsive to pivoting of said lever while said carrier strip is stationary to move into downward engagement with one of the labels from the strip so as to perform printing thereon; and e. a label receiving member detachably mounted to said casing at a front bottom portion thereof, said label receiving member including;

(1) a support frame;

(2) a label depressing member having an outer label engaging surface, mounted to said support frame;

(3) a resilient label receiving segment forward of said depressing member extending parallel to the label engaging surface of said label depressing member, one end of said label receiving segment being integrally connected to said support frame, the other end of said label receiving segment comprising a free end, said label receiving segment having a front edge defining a turnback part extending parallel to the label engaging surface of said label depressing member, spaced from said label depressing member so as to define a label forwarding space of fixed dimensions therebetween, (4) a label holding member extending above said label forwarding space from said support frame toward and above said label receiving segment, and (5) means, at said support frame, for detachably mounting said label receiving member to said casing;

said carrier strip feeding mechanism comprising means for feeding the carrier strip rearwardly along said label receiving segment and downwardly across said turnback part such that the labels are detached from the carrier strip at said turnback part and guided by said label holding member across said label forwarding space and beneath said label depressing member.

2. A labeler as in claim 1, wherein said support frame has a threaded hole, said detachably mounting means comprising a threaded member threadedly engagable with said threaded hole.

3. A labeler as in claim 1, wherein said label depressing member comprises a depression roller having an axis of rotation which extends parallel to said turnback part.

4. A labeler as in claim 3, wherein said support frame includes a horizontal portion above said depression roller, a vertical portion extending integrally downward from said horizontal portion rearward of said depression roller, said label holding member extending generally horizontally, integrally from the bottom edge of said vertical portion, said detachably mounting means being located above and slightly rearward of the axis of rotation of said depression roller.

* * * * *